US009189907B2

(12) United States Patent
Chen

(10) Patent No.: US 9,189,907 B2
(45) Date of Patent: Nov. 17, 2015

(54) ADJUSTING DEVICE FOR COIN COUNTING MACHINE

(71) Applicant: Chiu-Ming Chen, Lioujiao Township, Chiayi County (TW)

(72) Inventor: Chiu-Ming Chen, Lioujiao Township, Chiayi County (TW)

( * ) Notice: Subject to any disclaimer, the term of this patent is extended or adjusted under 35 U.S.C. 154(b) by 78 days.

(21) Appl. No.: 14/011,819

(22) Filed: Aug. 28, 2013

(65) Prior Publication Data

US 2015/0065022 A1 Mar. 5, 2015

(51) Int. Cl.

| | |
|---|---|
| ***G07D 3/00*** | (2006.01) |
| ***G07D 9/04*** | (2006.01) |
| ***G07D 9/00*** | (2006.01) |

(52) U.S. Cl.

CPC .. *G07D 9/04* (2013.01); *G07D 3/00* (2013.01); *G07D 9/00* (2013.01); *G07D 9/008* (2013.01)

(58) Field of Classification Search

CPC ..... G07D 3/00; G07D 3/02; G07D 3/06; G07D 3/128; G07D 5/00; G07D 9/008; G07D 9/04; G07D 9/06; G07F 1/047

USPC ..... 453/6, 10, 12, 13, 33–35, 49, 57, 63; 194/243, 249–259, 294–300, 302, 303, 194/310–314, 325–327, 333, 344, 346

See application file for complete search history.

(56) References Cited

U.S. PATENT DOCUMENTS

| | | | | |
|---|---|---|---|---|
| 2007/0066202 | A1* | 3/2007 | Hu et al. | 453/18 |
| 2008/0111332 | A1* | 5/2008 | Nabata | 280/79.11 |
| 2010/0263985 | A1* | 10/2010 | Li | 194/228 |

* cited by examiner

*Primary Examiner* — Jeffrey Shapiro

(74) *Attorney, Agent, or Firm* — Alan D. Kamrath; Kamrath IP Lawfirm, P.A.

(57) ABSTRACT

An adjusting device for a coin counting machine contains: a base including a plate member, an orifice, an adjusting hole, and a positioning hole. The plate member has the orifice screwing with a screw rod of an elastic fitting set, the adjusting hole, and the positioning hole. The adjusting hole has an adjusting post engaging with an elongated aperture of an adjustment piece, the positioning hole has a fixing post engaging with a fix aperture. An adjustment piece includes a tab, an extension, an arcuate sliding aperture, the elongated aperture, and the fix aperture. The elastic fitting set includes the screw rod, a resilient element, and a driving block, wherein the screw rod is screwed with the orifice via the arcuate sliding aperture and has the resilient element, and the driving block is fitted between the resilient element and the tab and is screwed with the screw rod.

5 Claims, 5 Drawing Sheets

ADJUSTING DEVICE FOR COIN COUNTING MACHINE

FIELD OF THE INVENTION

The present invent relates to an adjusting device for a coin counting machine which is capable of adjusting a bounce distance of coins with user's one hand.

BACKGROUND OF THE INVENTION

A conventional adjusting device for a coin counting machine contains an adjusting member and a plate member, wherein the adjusting member has a main piece, an adjustment orifice, a moving orifice, a regulating orifice. The main piece is disposed beside a coin outlet of a body of a plate member, and the adjustment orifice is defined at a central position of the main piece, the moving orifice is formed between the adjustment orifice and the regulating orifice and is used to fix the main piece on the plate member with a fixing element of the plate member. The regulating orifice is arranged on the main piece and is served to control a bounce distance of coins. Moreover, the plate member has a body, the fixing element, a first positioning element, and a second positioning element. The body is formed in a rectangle shape so as to be used as a working platform and has the coin outlet defined on the body, the fixing element is fixed with the moving orifice. In addition, the body has the first positioning element and the second positioning element mounted thereon so as to retain with the adjustment orifice and the regulating orifice of the adjusting member.

However, such a conventional adjusting device is complicated and has to be operated by user's two hands, thus having complicated structure and troublesome operation.

The present invention has arisen to mitigate and/or obviate the afore-described disadvantages.

SUMMARY OF THE INVENTION

The primary object of the present invention is to provide an adjusting device for a coin counting machine which is capable of adjusting a bounce distance of coins with user's one hand easily.

To obtain the above objectives, an adjusting device for a coin counting machine contains: a base including a plate member, an orifice, an adjusting hole, and a positioning hole.

The plate member has the orifice defined on one side thereof and screwing with a screw rod of an elastic fitting set, the adjusting hole and the positioning hole formed beside the orifice of the plate member, the adjusting hole has an adjusting post screwed therein and engaging with an elongated aperture of an adjustment piece, and the positioning hole has a fixing post screwed therein and engaging with a fix aperture.

An adjustment piece includes a tab, an extension, an arcuate sliding aperture, the elongated aperture, and the fix aperture, the tab has the extension extending outwardly from an outer peripheral side thereof, the arcuate sliding aperture is defined at a central position thereof, the elongated aperture is defined between the extension and the arcuate sliding aperture and has an internally wavy fringe for retaining with the adjusting post, and the fix aperture is formed on the outer peripheral side thereof so as to engage with the fixing post.

The elastic fitting set includes the screw rod, a resilient element, and a driving block, wherein the screw rod is screwed with the orifice via the arcuate sliding aperture and has the resilient element fitted thereon, and the driving block is fitted between the resilient element and the tab and is screwed with the screw rod.

DETAILED DESCRIPTION OF THE PREFERRED EMBODIMENTS

Figure 1:
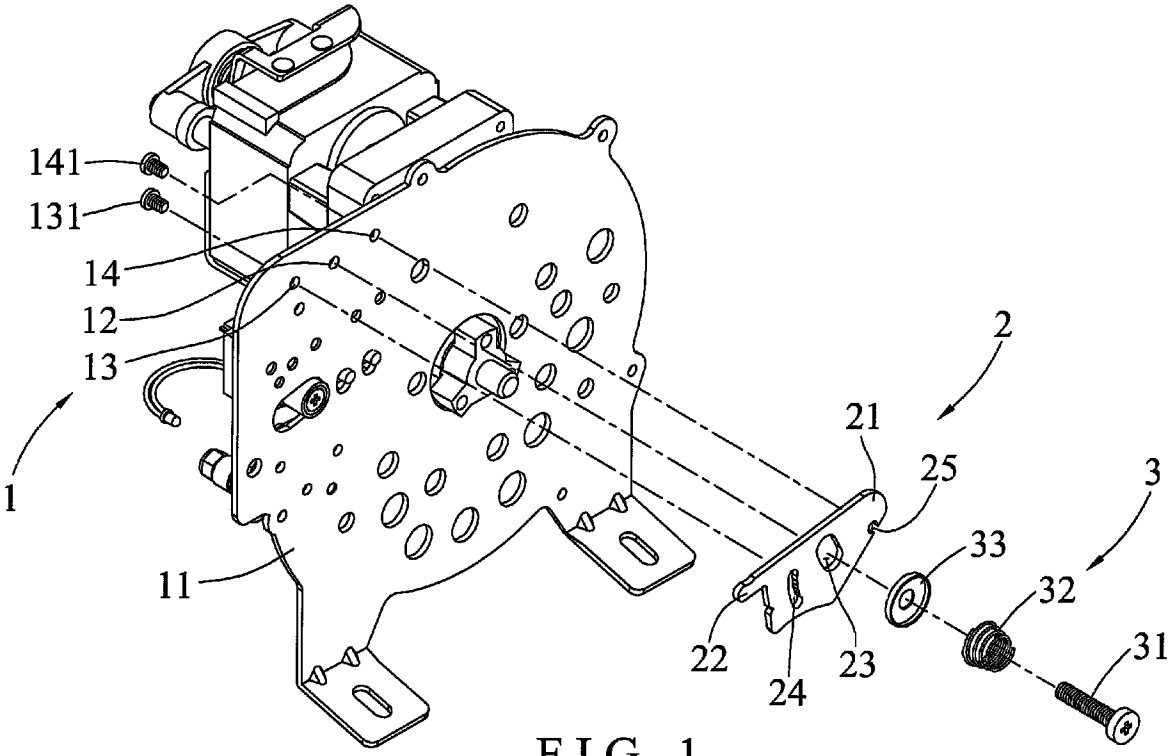
FIG. 1 is a perspective view showing the exploded components of an adjusting device for a coin counting machine according to a first embodiment of the present invention.
Figure 2:
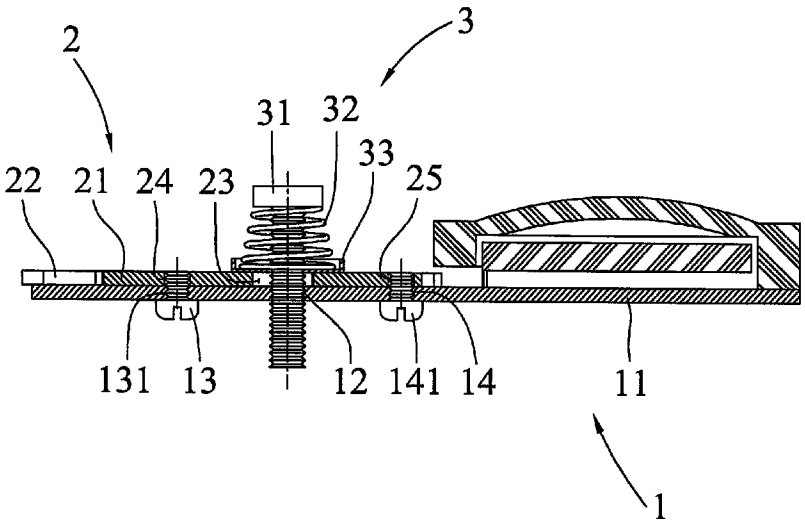
FIG. 2 is a cross sectional view showing the assembly of the adjusting device for the coin counting machine according to the first embodiment of the present invention.

With reference to FIGS. 1 and 2, an adjusting device for a coin counting machine according to a first embodiment of the present invention comprises: a base 1 including a plate member 11, an orifice 12, an adjusting hole 13, and a positioning hole 14. The plate member 11 is used as a working platform of a coin counting machine and has the orifice 12 defined on one side thereof and screwing with a screw rod 31 of an elastic fitting set 3, the adjusting hole 13 and the positioning hole 14 formed beside the orifice 12 of the plate member 11. The adjusting hole 13 has an adjusting post 131 screwed therein and engaging with an elongated aperture 24 of an adjustment piece 2, and the positioning hole 14 has a fixing post 141 screwed therein and engaging with a fix aperture 25.

The adjustment piece 2 includes a tab 21, an extension 22, an arcuate sliding aperture 23, the elongated aperture 24, and the fix aperture 25, wherein the tab 21 has the extension 22 extending outwardly from an outer peripheral side thereof, the arcuate sliding aperture 23 defined at a central position thereof, the elongated aperture 24 defined between the extension 22 and the arcuate sliding aperture 23 and having an internally wavy fringe for retaining with the adjusting post 131, and the fix aperture 25 formed on the outer peripheral side thereof so as to engage with the fixing post 141.

The elastic fitting set 3 includes the screw rod 31, a resilient element 32, and a driving block 33, wherein the screw rod 31 is screwed with the orifice 12 via the arcuate sliding aperture 23 and has the resilient element 32 fitted thereon, and the driving block 33 is fitted between the resilient element 32 and the tab 21 and is screwed with the screw rod 31.

Figure 3:
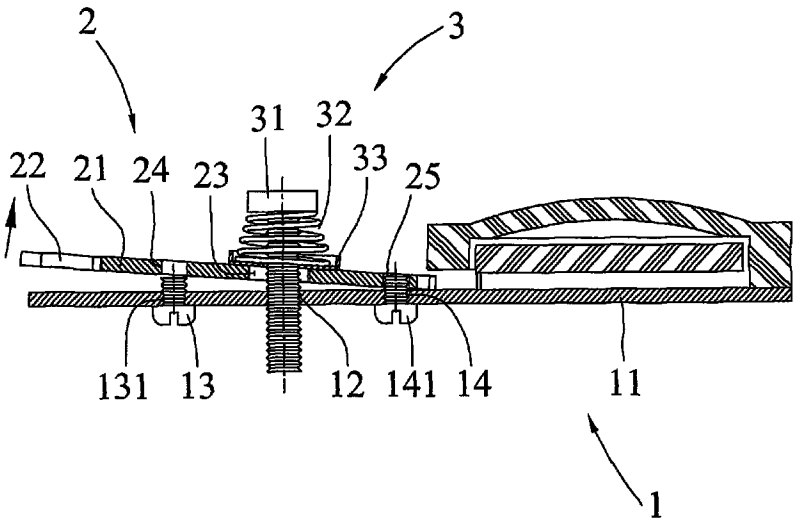
FIG. 3 is a cross sectional view showing the operation of the adjusting device for the coin counting machine according to the first embodiment of the present invention.
Figure 4:
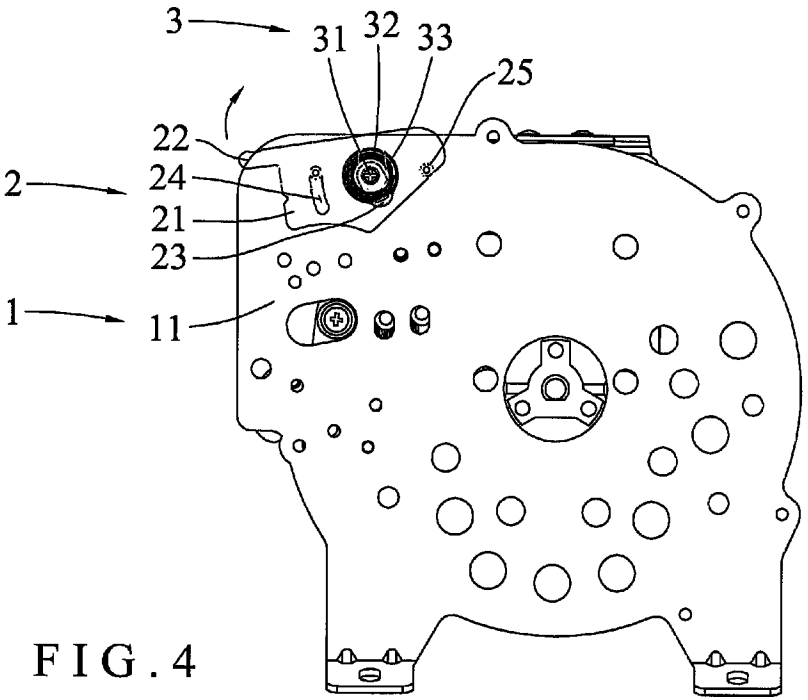
FIG. 4 is a plan view showing the operation of the adjusting device for the coin counting machine according to the first embodiment of the present invention.

As shown in FIGS. 3 and 4, in operation, the extension 22 of the tab 21 is rotated by user's one hand so as to drive the tab 21 to move upwardly, such that the fix aperture 25 engages with the fixing post 141, and the tab 21 tilts so that the elongated aperture 24 disengages from the adjusting post 131, the driving block 33 moves upwardly with the tab 21 so as to press the resilient element 32, thereafter the tab 21 rotates to a predetermined position along the fixing post 141 and then is released, and the resilient element 32 presses the tab 21 downwardly so that the elongated aperture 24 engages with the adjusting post 13 again, thus adjusting a bounce distance of coins.

Figure 5:
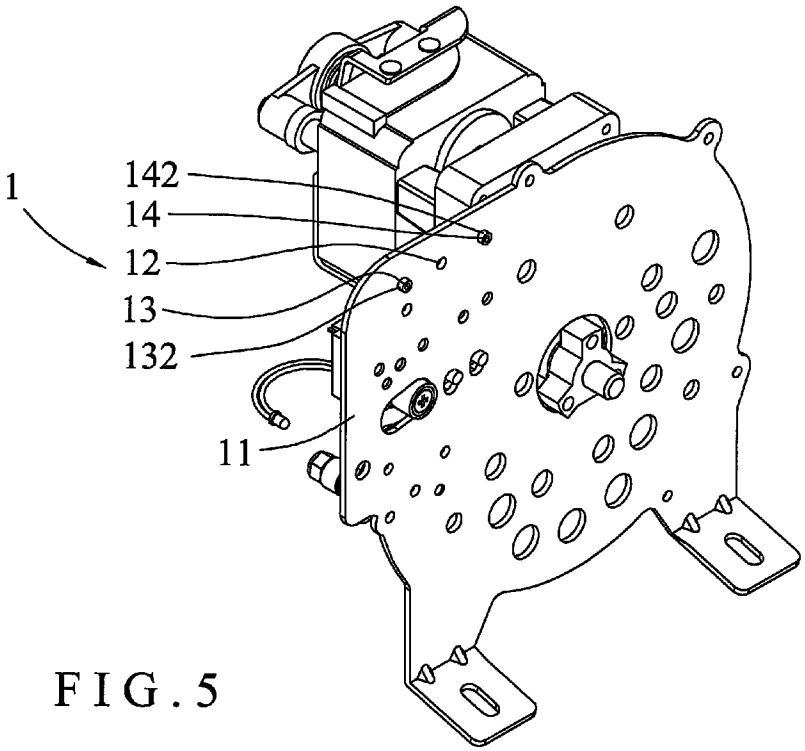
FIG. 5 is a perspective view showing the assembly of an adjusting device for a coin counting machine according to a second embodiment of the present invention.

Referring further to FIG. 5, a difference of an adjusting device for a coin counting machine of a second embodiment from that of the first embodiment comprises: a regulating protrusion 132 fixed in the adjusting hole 13 and one piece formed with the plate member 11, wherein the regulating protrusion 132 engages with the elongated aperture 24 of the adjustment piece 2. In addition, the adjusting device of the second embodiment also comprises a defining protrusion 142 arranged in the positioning hole 14 and one piece formed with the plate member 11, wherein the defining protrusion 142 engages with the fix aperture 25, thus simplifying structure and saving production cost.

Thereby, advantages of the adjusting device of the present invention are listed as follows:

The tab rotates to the predetermined position along the fixing post and then is released, thereafter the resilient element presses the tab downwardly so that the elongated aperture engages with the adjusting post again, and hence the user adjusts the bounce distance of coins with one hand easily.

Furthermore, the regulating protrusion is fixed in the adjusting hole and one piece formed with the plate member so as to engage with the elongated aperture of the adjustment piece, and the defining protrusion is arranged in the positioning hole and one piece formed with the plate member so as to engage with the fix aperture, thus simplifying structure and saving production cost.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An adjusting device for a coin counting machine comprising:

a base including a plate member, an orifice, an adjusting hole, and a positioning hole; the plate member having the orifice defined on one side thereof and screwing with a screw rod of an elastic fitting set, the adjusting hole and the positioning hole formed beside the orifice of the plate member, the adjusting hole having an adjusting post screwed therein and engaging with an elongated aperture of an adjustment piece, and the positioning hole having a fixing post screwed therein and engaging with a fix aperture;

an adjustment piece including a tab, an extension, a sliding aperture, the elongated aperture, and the fix aperture; the tab having the extension extending outwardly from the outer peripheral side thereof opposite to the fix aperture, the sliding aperture defined at a central position thereof, the elongated aperture defined between the extension and the sliding aperture, and the fix aperture formed on and communicating with the outer peripheral side thereof so as to engage with the fixing post;

the elastic fitting set including the screw rod, a resilient element, and a driving block;

wherein the screw rod is screwed with the orifice via the sliding aperture and has the resilient element fitted thereon, and the driving block is fitted between the resilient element and the tab and is screwed with the screw rod;

wherein after the extension of the tab is rotated to drive the tab to move upwardly, the fix aperture engages with the fixing post and the tab tilts, such that the elongated aperture disengages from the adjusting post, the driving block moves upwardly with the tab to press the resilient element, and the tab rotates to a predetermined position along the fixing post and then is released, thereafter the resilient element presses the tab downwardly so that the elongated aperture engages with the adjusting post again, thus adjusting a bounce distance of coins.

2. The adjusting device for the coin counting machine as claimed in claim 1, wherein the adjusting hole of the base has a regulating protrusion fixed therein and formed with the plate member.

3. The adjusting device for the coin counting machine as claimed in claim 1, wherein the positioning hole of the base has a defining protrusion arranged therein and formed with the plate member.

4. The adjusting device for the coin counting machine as claimed in claim 1, wherein the sliding aperture of the adjustment piece is arcuate.

5. The adjusting device for the coin counting machine as claimed in claim 1, wherein the elongated aperture has an internally wavy fringe for retaining with the adjusting post.

* * * * *